US006256964B1

(12) United States Patent
Drevfors

(10) Patent No.: US 6,256,964 B1
(45) **Date of Patent: *Jul. 10, 2001**

(54) METHOD OF HANDLING, FILLING AND SEALING PACKAGING CONTAINERS

(75) Inventor: Gunnar Drevfors, Åkarp (SE)

(73) Assignee: Tetra Laval Holdings & Finance S.A., Pully (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/341,360

(22) PCT Filed: Dec. 2, 1997

(86) PCT No.: PCT/SE97/02021

§ 371 Date: Jul. 9, 1999

§ 102(e) Date: Jul. 9, 1999

(87) PCT Pub. No.: WO98/32690

PCT Pub. Date: Jul. 30, 1998

(30) Foreign Application Priority Data

Jan. 29, 1997 (SE) ..... 9700261

(51) Int. Cl.[7] ..... B65B 55/04; B67B 1/06
(52) U.S. Cl. ..... 53/426; 109/468; 109/490
(58) Field of Search ..... 53/426, 468, 471, 53/473, 490, 109

(56) References Cited

U.S. PATENT DOCUMENTS

| | | | | |
|---|---|---|---|---|
| 2,995,882 | * | 8/1961 | Barnby | 53/266 |
| 3,377,775 | * | 4/1968 | Mattimoe | 325/395 |
| 3,483,666 | | 12/1969 | Harmes et al. | 53/59 |
| 3,564,805 | * | 2/1971 | Mumford | 53/468 |
| 3,943,682 | | 3/1976 | Rausing | 53/37 |
| 3,987,535 | * | 10/1976 | Brown | 53/381 |
| 4,094,124 | | 6/1978 | Ljungcrantz | 53/29 |
| 4,099,621 | | 7/1978 | Dullinger | 209/98 |
| 4,363,203 | | 12/1982 | Marshall et al. | 53/109 |
| 4,498,508 | * | 2/1985 | Scholle | 141/5 |
| 4,604,850 | | 8/1986 | Reil | 53/423 |
| 4,987,726 | * | 1/1991 | Petho et al. | 53/510 |
| 5,299,408 | * | 4/1994 | Dupoint | 53/432 |
| 5,368,828 | | 11/1994 | Carlson | 422/300 |
| 5,400,564 | * | 3/1995 | Humphries et al. | 53/75 |
| 5,546,831 | * | 8/1996 | Grant et al. | 81/3.44 |
| 5,639,432 | | 6/1997 | Carlson | 422/302 |

FOREIGN PATENT DOCUMENTS

| | | |
|---|---|---|
| 0 447 759 | 9/1991 | (EP) . |
| 2137970 | 10/1984 | (GB) . |

* cited by examiner

*Primary Examiner*—Peter Vo
*Assistant Examiner*—Hemant M. Desai
(74) *Attorney, Agent, or Firm*—Burns, Doane, Swecker & Mathis, L.L.P.

(57) ABSTRACT

A method of handling, filling and sealing prefabricated packaging containers that are provided with a closure device is disclosed. The packaging containers are transported in the closed state to a processing plant in which the closure device is opened, the packaging container and closure device are sterilized, and thereafter the packaging container is filled with the desired liquid contents. The same closure device that was removed from the packaging container is then reapplied to seal the container.

12 Claims, 1 Drawing Sheet

METHOD OF HANDLING, FILLING AND SEALING PACKAGING CONTAINERS

TECHNICAL FIELD

Figure 1:
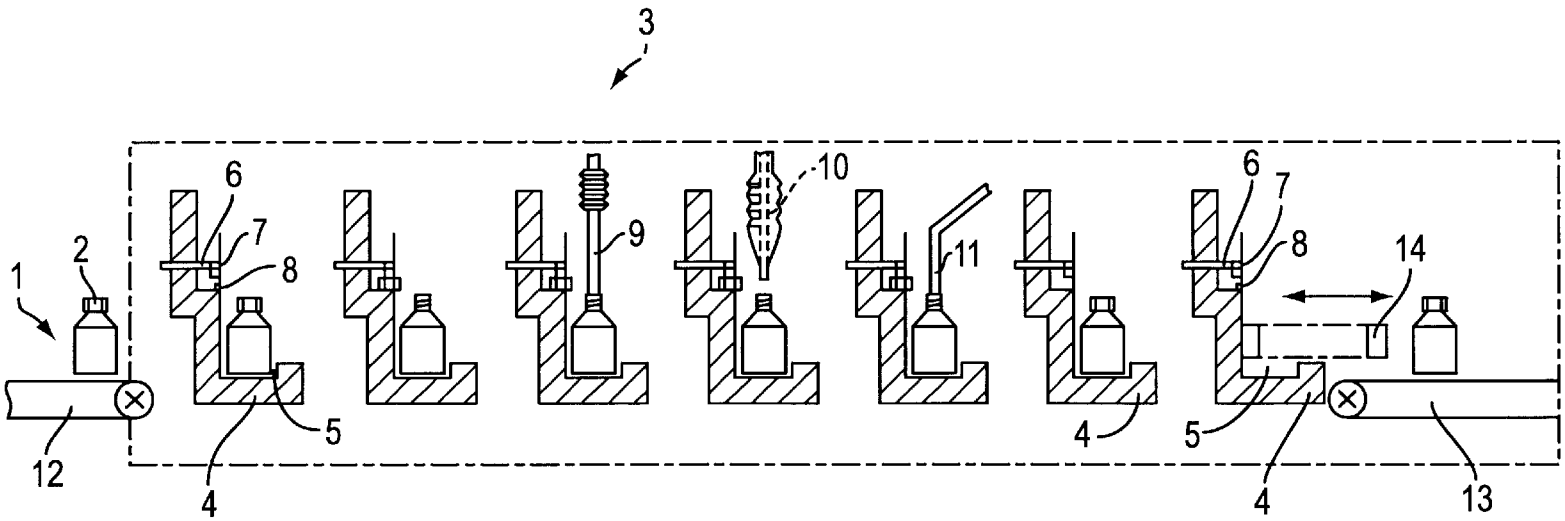

The present invention relates to a method of handling, filling and sealing prefabricated packaging containers provided with a closure device.

BACKGROUND ART

In the packing of various liquid foods, for example juice, milk or the like, in consumer packages of the type which comprises a container body of, for example, plastic or combinations of plastic and paper and also a closure device, it is normal that the packaging container body and the closure device are manufactured separately, whereafter they are transported individually to a filling machine by means of which the packaging containers are filled and provided with the closure device. During the transport of the packaging containers from the manufacturer to the juice or milk producer (i.e. the packer) dirt or foreign matter is prevented from entering into the packaging containers either with the aid of specifically designed protective sheets, or in that the packaging container bodies are packed in large crates, and protected with shrink film or by other means. Soiling of the closure devices is prevented in that the closure devices are packed in plastic bags or in crates. When the packaging containers are to be filled and provided with the closure devices at the packer, it becomes, therefore, necessary to free the packaging container bodies and closure devices from their protective envelopes and feed them individually into a filling machine which is also supplied with the product which is to be filled into the packaging containers. The separate handling of the packaging container bodies and the closure devices or screw caps, together with handling of the outer transport packaging is often seen as inconvenient by the packer, and requires extra personnel, for which reason there is a general need in the art to simplify this handling and, in a convenient manner, obviate the risk of dirt contamination of the packaging containers and the closure devices during transport from the producer to the packer.

In the aseptic packing of, for example, drinks not only are cleaning and inspection of the packaging container bodies necessary, but also sterilisation of both the packaging container bodies and the closure devices before the contents are packed into the packages. Such handling requires extra personnel and work at the packer's, for which reason an alternative solution is to carry out a cleaning and inspection of the packaging containers and the closure devices in an earlier stage, as well as to ensure that the transport packaging is such that the standard of hygiene is not jeopardised during transport from the producer to the packer. However, the risk of dirt contamination during transport and handling cannot be entirely precluded using present methods, which necessitates an additional inspection and possible cleaning of the individual packaging container bodies and closure devices prior to the final sterilisation, which is undertaken immediately before the filling operation proper.

In particular in aseptic packing, it is of crucial importance that the closure device and its surfaces and those of the packaging container which are to cooperate with one another in order to create an aseptically tight, i.e. bacteria-tight packaging container be also protected from mechanical damage during handling and transport. Even small chips and scratches in these surfaces jeopardise the bacteria-tightness of the finished packaging container to such an extent that the maintenance of the pristine sterile conditions cannot be guaranteed. These demands of preventing purely mechanical damage place further demands on, and further complicate, the outer transport packaging, for which reason there is an urgent need also from this viewpoint to simplify the handling methodology such that the risk of untightness is reduced. The fact that each closure device/packaging container body are not absolutely identical may also entail a risk of micro-leakage after closure and sealing of the packaging container, and so some form of tightness control is normal in order to ensure that the necessary manufacturing tolerances do not, under unfortunate circumstances, result in a given combination of packaging container body/closure device that fails to provide complete tightness.

OBJECTS OF THE INVENTION

One object of the present invention is therefore to realise a method of handling, filling and sealing prefabricated packaging containers, the method making it possible to simplify handling and transport of packaging containers and closure devices such that the above-outlined drawbacks are obviated.

A further object of the present invention is to realise a method of handling, filling and sealing prefabricated packaging containers, the method making it possible to avoid damage and dirt contamination of both the packaging container bodies and the closure devices.

Yet a further object of the present invention is to realise a method of handling, filling and sealing prefabricated packaging containers, which makes it possible to reduce personnel requirements by simplified handling, inspection and cleaning/sterilisation of both the packaging container bodies and the closure devices in connection with the packing of the contents into the containers.

Still a further object of the present invention is to realise a method of handling, filling and sealing prefabricated packaging containers, the method making for a dependable and high standard of hygiene, and also reducing the risk of leakage arising out of damage or manufacturing tolerances.

It is finally yet a further object of the present invention to realise a method of handling, filling and sealing prefabricated packaging containers, the method making it possible to realise a rational, rapid and dependable handling and filling of the packaging containers, at the same time as personnel requirements may be reduced and the majority of the previously known difficulties and drawbacks in such operations may be obviated.

SOLUTION

These and other objects have been attained according to the present invention in that a method of handling, filling and sealing prefabricated packaging containers provided with closure devices has been given the characterizing feature that each packaging container in the closed state is transported to a processing plant in which the closure device is opened and the packaging container is filled, whereafter it is re-closed by means of the same closure device. Preferred embodiments of the method according to the present invention have further been given the characterizing features as set forth in the appended subclaims.

BRIEF DESCRIPTION OF THE ACCOMPANYING DRAWING

One preferred embodiment of the method according to the present invention will now be described in greater detail hereinbelow, with particular reference to the accompanying, schematic Drawing which shows only those parts and details indispensable to an understanding of the present invention.

The FIGURE shows schematically and stepwise the method according to the present invention for handling, filling and sealing prefabricated packaging containers in a processing or filling plant.

DESCRIPTION OF PREFERRED EMBODIMENT

A packaging container 1 of bottle-shape and provided with a closure device 2 (e.g. a screw cap) is shown in the FIGURE during its stepwise advancement through a closed processing plant 3 provided with inlet and outlet sluice gates (not shown), for sterilising and filling the packaging containers 1. The different steps, which have been indicated by the designations A–G, are preferably disposed in sequence after one another and the packaging containers 1 are conveyed with the aid of carriers 4 between the different stages or stations. The carriers 4, as will be described in greater detail below, are stepwise displaceable between the different stations. The carriers 4 are preferably connected to a conveyor or drum (not shown) driven by a motor and thereby displaceable in an endless movement pattern in any optional conventional manner.

Each carrier 4 includes a recess 5 for a packaging container 1, the recess being designed such that the packaging container 1 not only stands reliably and steadily in the recess, but is also prevented from turning. Each carrier 4 further includes an arm 6 with, for example, a pneumatic gripping device 7 for the closure devices 2. The arm 6 is movable between an inactive position (e.g. in station A) and an active position (illustrated in station F). The gripping device 7 is, as was mentioned above, provided with, for example pneumatic devices which make it possible to temporarily unite the closure device 2 with the gripping device 7. When the closure device 2 is, as illustrated, in the form of a screw cap, the gripping device 7 is also provided with a reciprocally rotatable portion making for screwing on and off, respectively, of the closure device 2 in relation to the packaging container body. In its inactive position, the gripping device 7 of the arm 6 is located immediately above a nozzle 8 integral in the carrier 4, which, as will be described later, is optionally connectable to a source of sterilisation agent or a source of sterile air, respectively, (not shown). In station C, a pipe 9 is illustrated which is vertically displaceable into and out of the packaging container body, respectively, and optionally connectable to the above-mentioned source of sterilisation agent. In station D, a further pipe 10 is shown which is likewise vertically displaceable and connectable to the packaging container body and also capable of being connected to the above-mentioned source of sterile air. In station E, there is shown a likewise vertically reciprocal filler pipe 11 which is connectable to a source (not shown) of the desired contents of the packaging containers, e.g. juice or milk.

Ahead of and after the processing plant 3, there are shown an infeed conveyor 12 and a discharge conveyor 13, which may be of optional type and disposed, in a per se known manner, to feed in and discharge packaging containers 1 provided with closure devices 2 from the processing plant 3. At the discharge conveyor 13, there is schematically illustrated a transfer device 14 in order to make for displacement of each individual, filled and sealed packaging container 1 from a carrier 4 to the discharge conveyor 13. It is assumed that the transfer device may be of conventional, known type and that a corresponding, or otherwise designed transfer device may also be provided at the infeed conveyor 12 in order to transfer empty packaging containers 1 provided with closure devices 2 to a vacant carrier 4.

On the handling, filling and sealing of packaging containers in according with the method according to the present invention, the manufacturer produces finished packaging containers such that they are complete with the closure device of the desired type. In the type of packaging container illustrated in the Figure, e.g. a bottle-shaped packaging container manufactured of plastic and with a threaded neck, the packaging container is thus provided, after interior cleaning, with the tightly closing closure device 2 which is in the form of a screw cap. The screw cap is tightened completely, i.e. cooperating sealing surfaces on the neck of the packaging container and in the screw cap are brought together in gas-tight fashion such that the interior of the packaging container body is protected against both bacteria and contaminants of other types. In this state, the sealing surfaces will also be protected against mechanical action, and packing of the thus closed and sealed packaging containers for transport to the packer, i.e. the juice or milk producer, may technically be carried out without protective outer transport packaging. For practical reasons, such transport normally however takes place using pallets or crates, but there is nothing to prevent the packages from being packed in bulk in larger transport trays or the like. On arrival at the drink producer who is to pack, for example, juice or milk in the packaging containers, these are placed on the infeed conveyor 12 which, by the intermediary of transfer devices (not shown) displaces one packaging container at a time to a vacant carrier 4, where the packaging container 1 is fitted in the recess 5 so that it is firmly fixed and non-rotary in relation to the carrier 4. During transfer from station A to station B, the arm 6 executes a reciprocating movement, the gripping device 7 being brought into engagement with the closure device 2, rotating it such that it is mechanically released from the packaging container body, and returning to the position of rest carrying with it the closure device 2 which, in such instance, will be placed immediately above the nozzle 8 in the carrier 4. A further stepwise displacement of the carrier 4 moves the packaging container body and the closure device to station C, where the vertically reciprocating pipe 9 is fed down into the opening of the packaging container and is connected to the source of sterilisation agent, e.g. gas or spray-form hydrogen peroxide. After the aspiration of the requisite quantity of sterilisation agent into the packaging container body, the pipe 9 is removed and the packaging container is displaced to station D, where the pipe 10 is, in a corresponding manner, displaced down into the opening of the packaging container and is connected to a source of hot sterile air. Hereby, the sterilisation agent will, in a known manner, be vaporised and depart from the interior of the packaging container. The pipe 10 is preferably provided with a surrounding sleeve entrapping and leading off the vaporised sterilisation agent. After completed sterilisation, the pertinent packaging container is displaced to station E, where a vertically movable filler pipe 11 is lowered into the packaging container and connected to a source of the intended contents. After completed filling, the filler pipe is once again removed and the packaging container is displaced to station F, during which displacement the arm 6 executes a new movement once again to displace the closure device 2 to a position immediately above the neck of the packaging container and, by rotation of the gripping device 7, to close and seat the packaging container in liquid-tight fashion by means of the screw cap. Hereafter, the arm returns to its position of rest and the packaging container is displaced to station G, where it is removed, by means of the transfer device 14 from the recess 5 of the carrier 4 and is transferred to the discharge conveyor 13 for further transport to packing and distribution to the consumer retail outlet.

As was previously mentioned, the closure device removed from the packaging container body during transport through the processing plant 3 will, when the arm 6 is located in its rest position, be situated immediately above the nozzle 8 in the carrier 4. During the movement of the carrier through the processing plant 3, the nozzle is, by the intermediary of channels (not shown), placed in communication with the source of sterilisation agent and thereafter with the source of hot sterile air, for which reason a similar sterilisation operation of, above all, the interior surface of the closure device 2 subsequently to come into contact with the contents of the container, is undertaken. In other words, when the closure device 2, after filling of the packaging container 1, is once again applied in gas-tight fashion thereon, not only the interior of the packaging container proper but also the closure device 2 will be sterilised such that the sterility of the contents of the packaging container is ensured. The contents are themselves sterile, since they have, in a per se known manner, previously been freed of living micro-organisms and bacteria, for example by a heating process.

In those cases when a sterile packaging container is not desired, the processing plant 3 need, naturally, not be provided with stations C and D, but the packaging container 1 can, after removal of the closure device 2, be immediately brought into contact with the filler pipe 11 in order to be filled and thereafter once again closed and sealed. It is also conceivable to introduce, into the processing plant 3, further processing stations, for example for inspection of the tightness of the packaging container after the application of the closure device, or the like.

By the transport of the complete, closed, packaging container from the manufacturer to the packer, it will thus be ensured that, despite the use of simple means and fundamentally without the need of outer transport packaging, it is possible to transport a previously cleaned and finished packaging container without the risk of either interior dirt contamination or damage to the sealing surfaces of either the packaging container proper or the closure device. Delivery of a complete packaging container to the processing plant 3 renders unnecessary the previously required, costly handling of a quantity of separated protective inserts and outer packaging, which, together with the fact that separate handling of closure devices, for example loading into a magazine, infeed, etc., is no longer necessary, this reducing personnel requirements as compared with previously known, similar processing plants where separate infeed and possible cleaning and inspection of both the packaging containers and the closure devices 2 are necessary. Inspection of the tightness of the filled and closed packaging containers is rendered unnecessary in most cases, since this inspection—thanks to the already known combination of packaging container body and closure device—may be undertaken in connection with the production thereof at the manufacturers. The normally necessary inspection and possible extra cleaning of the interior of the packaging container to ensure that dirt or foreign matter has not entered the packaging container body during transport to the packer is also dispensed with, and as a result of these features together, the method according to the present invention offers a number of cost-saving advantages as compared with prior art similar methods.

The present invention should not be considered as restricted to that described above and shown on the Drawing, many modifications being conceivable without departing from the scope of the appended Claims.

What is claimed is:

1. A method of handling, filling, and sealing prefabricated packaging containers provided with a closure device, the packaging container having a first sealing surface and the closure device having a second sealing surface, comprising the steps of:

transporting each packaging container in the closed state to a processing plant with the first and second sealing surfaces cooperating to seal the container;

opening the closure device at a first location;

transporting the closure device with the packaging container to a second location along the same path;

filling the packaging container at the second location; and once again closing the container by means of the same closure device with the first and second sealing surfaces cooperating to again seal the container.

2. The method as claimed in claim 1, wherein the processing plant has a carrier and the packaging container and its associated closure device are supported on the carrier while the opening step and the filling step and the closing step are being performed.

3. The method as claimed in claim 2, wherein the packaging container and its associated closure device are mutually transported by means of the carrier to a sterilisation station and are subjected to a sterilisation operation before the filling step.

4. The method as claimed in claim 3, wherein each packaging container with its associated closure device is displaced by means of a carrier from the sterilisation station to a filling station where the packaging container is filled with the intended contents and is closed and sealed by means of its associated closure device.

5. A method of filling and sealing a prefabricated packaging container while maintaining sterile conditions in the container comprising the steps of:

(a) supplying a prefabricated packaging container to a processing plant, the container being closed by a closure device, the container having a first sealing surface, the closure device having a second sealing surface, the first and second sealing surfaces cooperating to seal the container;

(b) removing the closure device from the container at a first location;

(c) transporting the closure device with the container to a second location along the same path;

(d) filling the container at the second location; and (e) replacing the same closure device that was removed in step (b) on the container with the first and second sealing surfaces cooperating to again seal the container.

6. The method according to claim 5, wherein the closure device is a screw cap, and the removing step includes unscrewing the screw cap.

7. The method according to claim 6, including placing the container while closed by its associated screw cap on a carrier, removing the screw cap while the container is on the carrier, and retaining the screw cap on the carrier during the filling step.

8. The method according to claim 5, including sterilizing the interior of the packaging container between the removing step and the filling step.

9. The method according to claim 8, including sterilizing the closure device.

10. The method according to claim 8, including placing the container while closed by its associated closure device on a carrier, and maintaining the container and its associated closure device on the carrier while performing the removing, sterilizing, filling and replacing steps.

11. A method of handling, filling, and sealing prefabricated packaging containers provided with a closure device, the packaging container having a first sealing surface and the closure device having a second sealing surface, comprising the steps of:

transporting each packaging container in the closed state to a processing plant with the first and second sealing surfaces cooperating to seal the container;

opening the closure device;

sterilizing the closure device and the packaging container after the opening step;

filling the packaging container after the sterilizing step; and once again closing the container by means of the same closure device with the first and second sealing surfaces cooperating to again seal the container.

12. A method of filling and sealing a prefabricated packaging container while maintaining sterile conditions in the container comprising the steps of:

(a) supplying a prefabricated packaging container to a processing plant, the container being closed by a closure device, the container having a first sealing surface, the closure device having a second sealing surface, the first and second sealing surfaces cooperating to seal the container;

(b) removing the closure device from the container;

(c) sterilizing the closure device and the container after the removing step;

(d) filling the container after the sterilizing step; and (e) replacing the same closure device that was removed in step (b) on the container with the first and second sealing surfaces cooperating to again seal the container.

* * * * *